US006149373A

United States Patent [19]

Gesuale

[11] Patent Number: 6,149,373

[45] Date of Patent: Nov. 21, 2000

[54] RIM ENGAGING CONTAINER MANIPULATION APPARATUS

[76] Inventor: Thomas Gesuale, 36 Landview Dr., Dix Hills, N.Y. 11746

[21] Appl. No.: 09/465,626

[22] Filed: Dec. 17, 1999

[51] Int. Cl.[7] ..... B66F 9/18

[52] U.S. Cl. ..... 414/607

[58] Field of Search ..... 414/607; 187/237

[56] References Cited

U.S. PATENT DOCUMENTS

| | | | |
|---|---|---|---|
| 2,827,189 | 3/1958 | Knudstrup | 414/607 |
| 3,176,866 | 4/1965 | Meister, Jr. | 414/607 |
| 3,396,862 | 8/1968 | Fischer | 414/607 |
| 3,918,600 | 11/1975 | Lyon | 414/607 X |
| 3,966,069 | 6/1976 | Fathauer | 414/607 |
| 3,971,485 | 7/1976 | Hoppey | 414/607 |
| 5,230,599 | 7/1993 | Orr | 414/607 |
| 5,281,073 | 1/1994 | Gesuale . | |

FOREIGN PATENT DOCUMENTS

| | | | |
|---|---|---|---|
| 647244 | 2/1979 | U.S.S.R. | 414/607 |
| 1271815 | 11/1986 | U.S.S.R. | 414/607 |
| 1482883 | 5/1989 | U.S.S.R. | 414/607 |
| 1333825 | 10/1973 | United Kingdom | 414/607 |

*Primary Examiner*—Steven A. Bratlie
*Attorney, Agent, or Firm*—Ike Aruti, Esq.

[57] ABSTRACT

An apparatus is provided for the lifting and manipulation of bulk material containers having at least a pair of externally protruding lips or a peripheral rim. The device has a frame adapted to be engaged by one or more kinds of moving machines, such as a forklift, and has a pair of substantially parallel, forward extending container engagement rails. The container engagement rails each have one or more inwardly directed lips which form a shelf or channel, upon or between which a container is supported and captivated for lifting and manipulation by externally projecting lips or rim. The container engagement rails may be vertically displaced from the machine engagement means to more efficiently utilize the lifting range of the machine, and the container engagement rails may be movably mounted to the frame to aid in handling conainers which have become distorted.

7 Claims, 9 Drawing Sheets

RIM ENGAGING CONTAINER MANIPULATION APPARATUS

FIELD OF THE INVENTION

The present invention relates to material handling equipment, and more particularly, to an apparatus for the engagement and manipulation of bulk material containers.

BACKGROUND OF THE INVENTION

Many of the wonderful conveniences of modern life are made easily available to ordinary people through the economic efficiency of mass production and other high volume processing techniques, of which virtually all require materials to be brought to and from particular locations in bulk quantities. Consequently, many varieties of bulk material containers used commercially have become well known. They are used for the accumulation, storage and transport of solid and liquid matter, and at all stages of the life of the contained matter, whether raw material, processed product, or waste remaining after usage or consumption of the product. Such large capacity containers are typically substantially rectangular in shape, for easy accommodation by trucks and railway cars.

A contemporary variant of such a container is exemplified in U.S. Pat. No. 5,281,073, incorporated herein by reference as if more fully set forth. The designs shown therein have the desirable feature of being nestable configurations, which in turn allows for more efficient utilization of space, whether during storage or transport, when the containers are empty. Another feature of the multiple aperture construction taught therein is that the containers may be carried or manipulated using machinery having common forklift type blades. This feature may not necessarily be beneficial, since when exploiting the nestability of the container design, the apertures further from the ground must be accessed, and in practice a common size for the container is on the order of twenty feet long, eight feet wide, and four feet high. This would require that a lifting fork, to be fully useful in stack operations with such containers, while only requiring four to six feet of vertical lifting travel to clear a stack of containers, be raised to an overall height of perhaps eight or ten feet, since lifting in stack operations begins at a point approximately four feet high. This may well exceed the range of smaller forklifts otherwise capable of lifting such containers. In practice it thus becomes necessary to use a larger forklift to handle the containers for stack operations, which seems wastefully inefficient when considering the containers are usually empty at this stage, and therefore lightest in weight.

Another consideration exists as pertains to the structures of the container which have apertures for lifting by insertion of forklift blades therethrough, such as the container side walls or support rails. The relatively small area of the structure defining the apertures must withstand supporting the container when loaded to capacity, being handled roughly, and perhaps being driven quickly across rough surfaces.

These apertured components must be fabricated of thicker and stronger material than would otherwise be required because not only must the container and the load therein be supported, but to resist damage localized to the aperture areas caused by the inserted blades during rough or abusive handling operations. The disadvantage of apertures and blade through handling therefore exact their price in container fabrication cost, as well as lost payload capacity, reduced life span, and the full host of other penalties associated with the additional container weight. In the case of container designs having upper longitudinal support rails, the weight problem caused by increasing the structure size to compensate for the weakness caused by the apertures and the blade therethrough handling, is exacerbated by the fact that these oversized and overweight rails are often extended across the ends of the container to form an external continuous, perimetric reinforcing rim.

Another disadvantage of the aforementioned container design is that it necessitates an approach from the side of the container by a manipulating vehicle. Under many circumstances it may be desirable to transport the container in enclosed fashion, such as in the box type body of a truck, railway car, or shipping container. This may be because it is desirable to prevent external foreign matter from contaminating the material carried in the container, or to prevent loss of the contained material, or to prevent exposure to the elements. It may also be desirable for financial considerations because such enclosed shipping bodies are very plentiful and inexpensively available for transporting the containers or material in them.

While the size and shape of these containers often enables their carriage within these box type shipping bodies, these enclosed bodies typically open at the ends for loading and unloading. This requires that the containers be carried and lifted for loading and unloading into box bodies by machinery from a position longitudinally oriented to the end of the container. The task is not ordinarily possible by a single manipulating machine which as described above, is positioned transversely oriented to the side of the container. In order to load such a container into a common box body with a single forklift, some form of staging platform must be used where the container can be placed in alignment with the opening in the box body, and then a ramp to the staging platform provided so the forklift can push the container in a longituinal direction into the box. Even with the additional cost and space requirements of the ramp and staging platform, the dragging and sliding of the container would likely prove destructive to both the container and the floor of the box body. To address this problem by adding wheel elements to the containers would again add weight, complexity and cost to the operation.

Consequently, a need exists for a tool or apparatus which enables an ordinary forklift type machine to engage the upper peripheral rim or lip of a bulk material container, so that the container can be lifted, carred or manipulated thereby.

OBJECTS AND ADVANTAGES

Accordingly, it is an object of the instant invention to ameliorate the above noted disadvantages and deficiencies in bulk material container handling.

It is another object of the instant invention to provide an apparatus which captivates the external lip or rim of a container to enable the lifting and manipulation of the container by common forklift means.

Another object of the present invention is to provide an apparatus which enables an ordinary forklift to lift and manipulate a container without need for apertures through the container structure.

Still another object of the instant invention is to provide a container lifting and manipulation apparatus for use with an ordinary forklift which allows reduction of the cost and weight of the container.

Yet another object of the instant invention is to provide a container lifting and manipulation apparatus which enables a forklift to engage a container from a position oriented in longitudinal alignment with the end of the container.

A further object of the instant invention is to provide a container lifting and manipulation apparatus for use with a forklift, which vertically offsets the lifting range of the forklift.

Yet a further object of the instant invention is to provide a container lifting and manipulation apparatus which allows stack operations with a forklift no larger than necessary to carry the container.

Still a further object of the instant invention is to provide a container lifting and manipulation system which spreads the load of lifting and manipulation of a container across a larger area than blade apertures.

Another object of the instant invention is to provide an apparatus for the lifting and manipulation of containers which engages an exterior rim or lips of the container, and which can accommodate containers which are physically distorted.

Other objects, features and advantages will become apparent to those of skill in the art upon contemplation of the disclosure herein in connection with the accompanying drawings. It is to be understood, however, that the drawings are designed for the purpose of illustration only, and are not intended as a definition of the limits of the scope of the instant invention, for which reference should be made to the claims appended hereto.

SUMMARY OF THE INVENTION

The present invention overcomes the above noted drawbacks to the prior known devices and systems for manipulating bulk material containers, as well as enhancing the productive usefulness and life span of bulk material containers themselves, whose structural design suffer accelerated deterioration when used with such devices and systems, by providing a tool which engages and captivates a substantial portion of a container's external peripheral lip or rim by which the container may then be lifted and manipulated using ordinary forklift type machinery.

The apparatus comprises a frame having a pair of forward extending, substantially parallel members, which have inwardly directed opposing lips which form a shelf or channel, upon or between which a container is supported by engagement under or around the container's external peripheral lip. The best mode presently contemplated for most applications uses a pair of U-channels. The U-channels are horizontally oriented so that their open channels face inwardly opposing one another. The distance between the U-channels is determined by the dimensions of the containers to be handled, and may thus be selected in order to enable approach and engagement of the container from the wide side or the narrow end as may be preferential under the circumstances.

The frame of the instant apparatus is further provided with one or more receiving means, such as apertures, bores or channels so that the apparatus can be engaged by the insertion of forklift blades or other common machine coupling means. Further embodiments of the apparatus provide the receiving means for forklift blades at a location on the frame displaced vertically below the U-channels so that required vertical lifting range of the forklift is minimized or more efficiently used.

BRIEF DESCRIPTION OF THE DRAWINGS

In the drawings, wherein the same reference numeral identifies the same element throughout the several views.

DETAILED DESCRIPTION OF THE PREFERRED EMBODIMENTS

Figure 1:
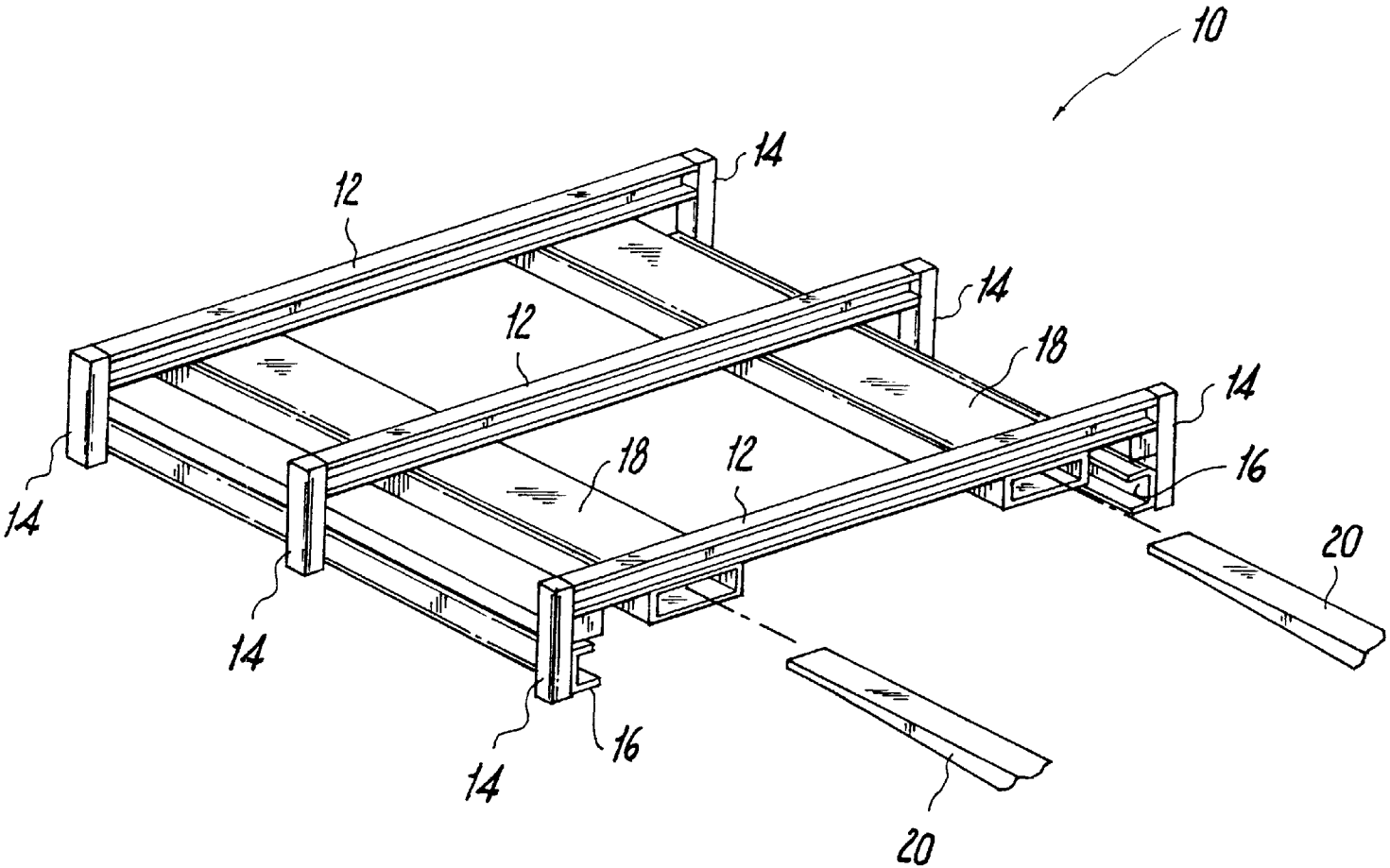
FIG. 1 is an illustration of a first embodiment of the container handling apparatus of the instant invention.

A most simple and inexpensive embodiment of the container manipulation apparatus of the instant invention is presented in FIG. 1, and denoted generally by the numeral 10. It is contemplated primarily for use with rectangular nestable containers of the type shown in FIG. 2, although it is generally useful with any container having at least a pair of substantially opposite externally protruding lips.

The frame of the apparatus has transverse structural elements 12, and at the ends thereof depending vertical support members 14 are connected. Coupled to the depending vertical support members 14, below transverse frame elements 12 are a pair of substantially parallel, longitudinally disposed container engagement rails 16, which are in the form of U-channels, oriented so that the open sides of the channels are facing each other. Also mounted to transverse structural frame elements 12 are means for engagement of a moving machine, here in the form of a pair of rectangular tubing sections 18 for receiving the blades 20 of a forklift, a forklift being contemplated as the moving machine of choice for most applications.

The distance between engagement rails 16 is chosen according to whether the container to be manipulated will be approached transversely or longitudinally. In either case this distance will be slightly greater than the container body dimension, be that length or width, respectively, and slightly less than the overall dimension of the outsides of opposite externally protruding lips at the ends or sides of the top of the container. The width of the channel on each engagement rail 16 is at least the height of the exterior lip or rim at the top of the container to be manipulated, although a somewhat looser fit has been found to reduce the sensitivity of the apparatus to slight misalignments, which make it easier to use.

Figure 2:
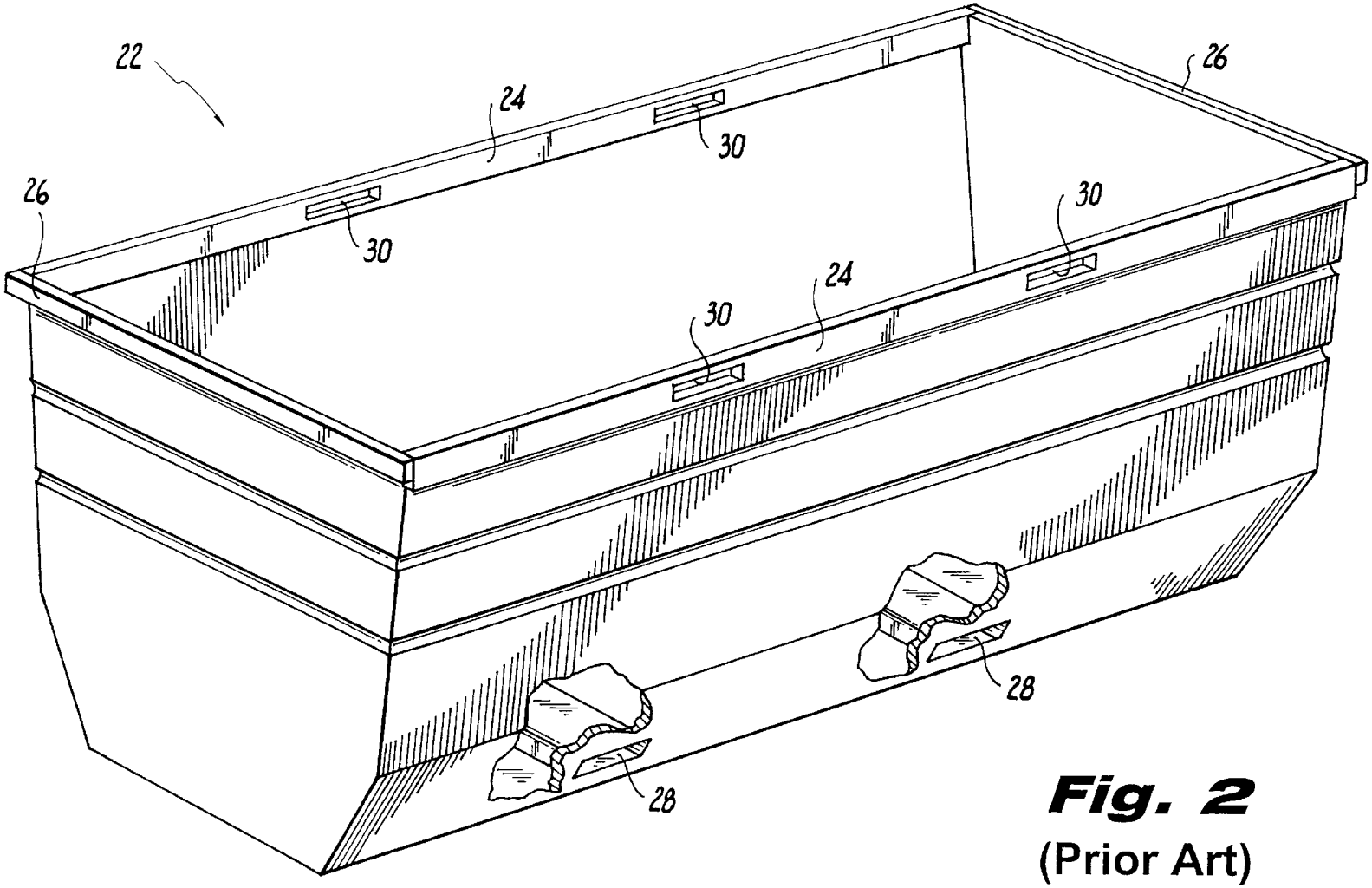
Fig. 2 (Prior Art)
FIG. 2 is an illustration of a prior art nestable bulk material container of the type generally contemplated for use with the instant invention.

The apparatus 10 can then be slid onto the top of a bulk material container 22, of which a typical example is depicted in FIG. 2, with opposite external lips or rim of the container captivated within the channels of engagement rails 16. This general configuration of container has become common in recent years because it has a body which is slightly tapered from top to bottom, allowing similarly constructed containers to nest substantially within one another, which makes them space efficient for storage or transport in quantity when empty. The example container 22 of FIG. 2 has a pair of longitudinal support rails 24 at the top of the side walls, and another pair of transverse support rails 26 at the top of the end walls so that a continuous externally protruding peripheral rim is formed having paired end lips and side lips around the container top. It should be noted that only one pair of these external projecting lips is necessary for use of the apparatus of the instant invention, however, a fully peripheral rim is shown as it is common practice due to the beneficial effect on the overall rigidity of the container.

Container 22 is further constructed with a pair of lower apertures 28 at the base, and transversely aligned pairs of upper apertures 30 at the top of the container. While only one pair of apertures, upper or lower, is necessary to lift or manipulate a single container, it should be noted that when two or more containers are nested in a stack, the upper container is accessible only by the upper apertures, the bottom container accessible only by the bottom apertures, and accessing the bottom container accesses the entire stack. Experience has shown the upper support rails 24 to be prone to damage localized to the area around apertures 30, undoubtedly because all the stresses of carrying and manipulating the container are concentrated by the forklift blades into relatively ;mall areas of the apertures, which are only on the order of ten inches wide. Contributing to the problem is the fact that the apertures substantially weaken the support rails.

Figure 4:
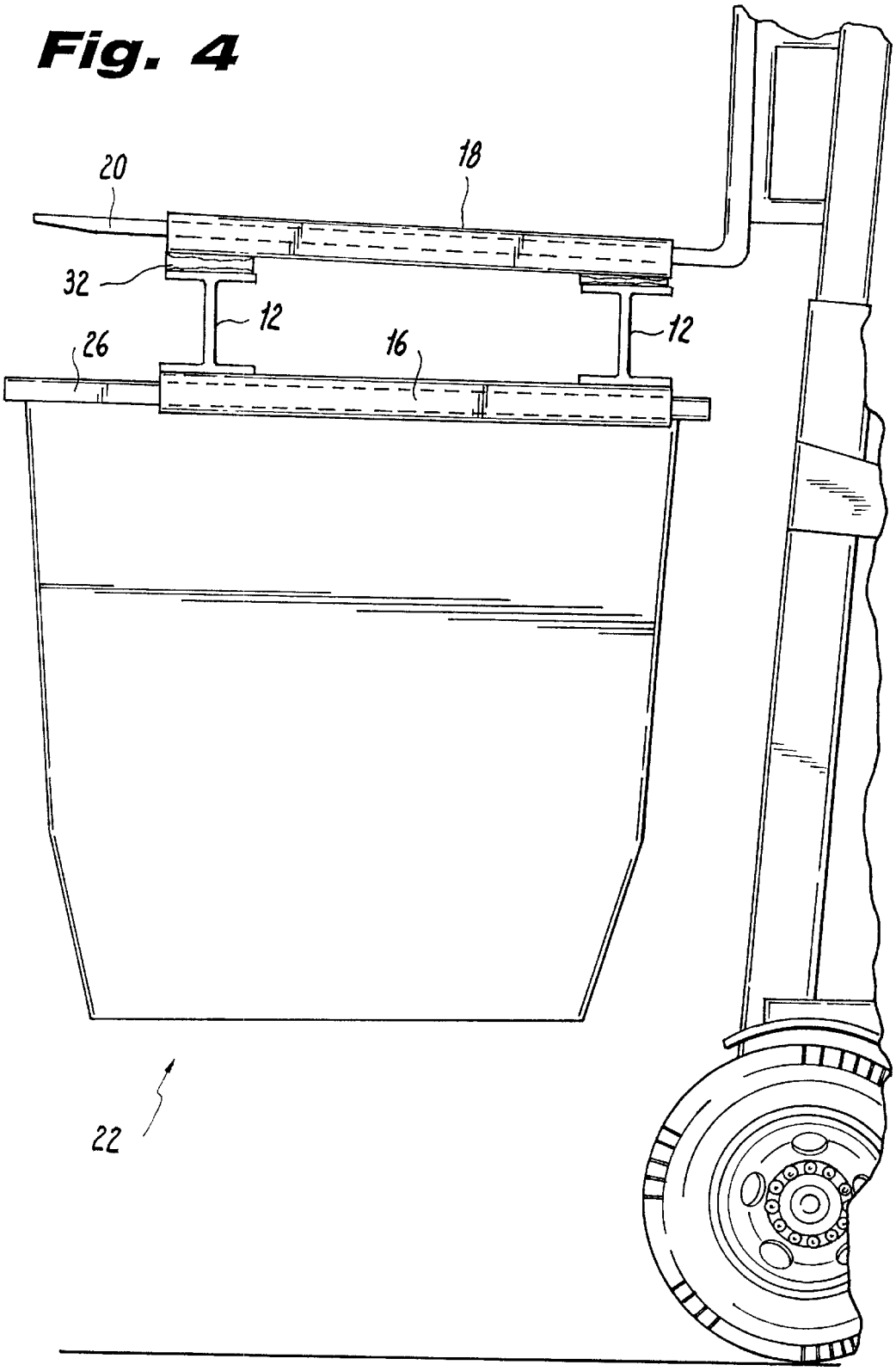
FIG. 4 is a side view illustration of the second embodiment of the container handling apparatus of the instant invention shown fully engaging a bulk material container.
Figure 5:
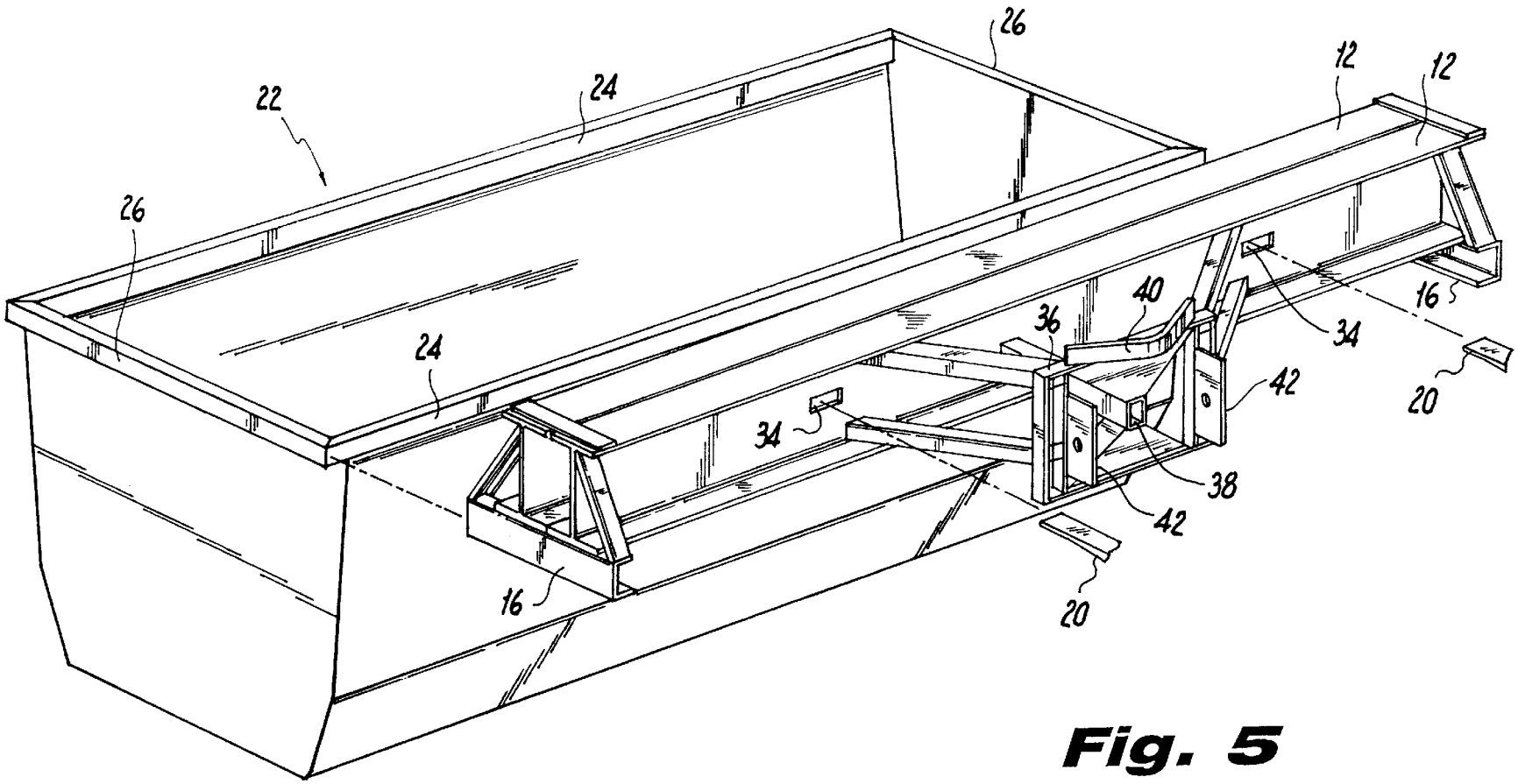
FIG. 5 is a perspective view of a heavier service variation of the present invention shown in the embodiment of FIG. 4, illustrating multiple alternative means for engagement by a prime mover.

Turning now to FIGS. 4 and 5 which show a second embodiment of the present invention, it should become more apparent that the extended length of engagement rails 16 distribute the handling loads across an area many times greater than the two pairs of top apertures. This advantage is common to all embodiments of the instant invention, reducing the wear and tear and lengthening the useful life of the containers. When combined with the fact that the apertures 30 may be deleted from support rails 24 as unnecessary without loss of utility, and with the consequent elimination of weak spots, the instant invention adds sufficient robustness that containers designed for use with the instant apparatus may be made even lighter in weight and at lesser cost than otherwise.

Figure 3:
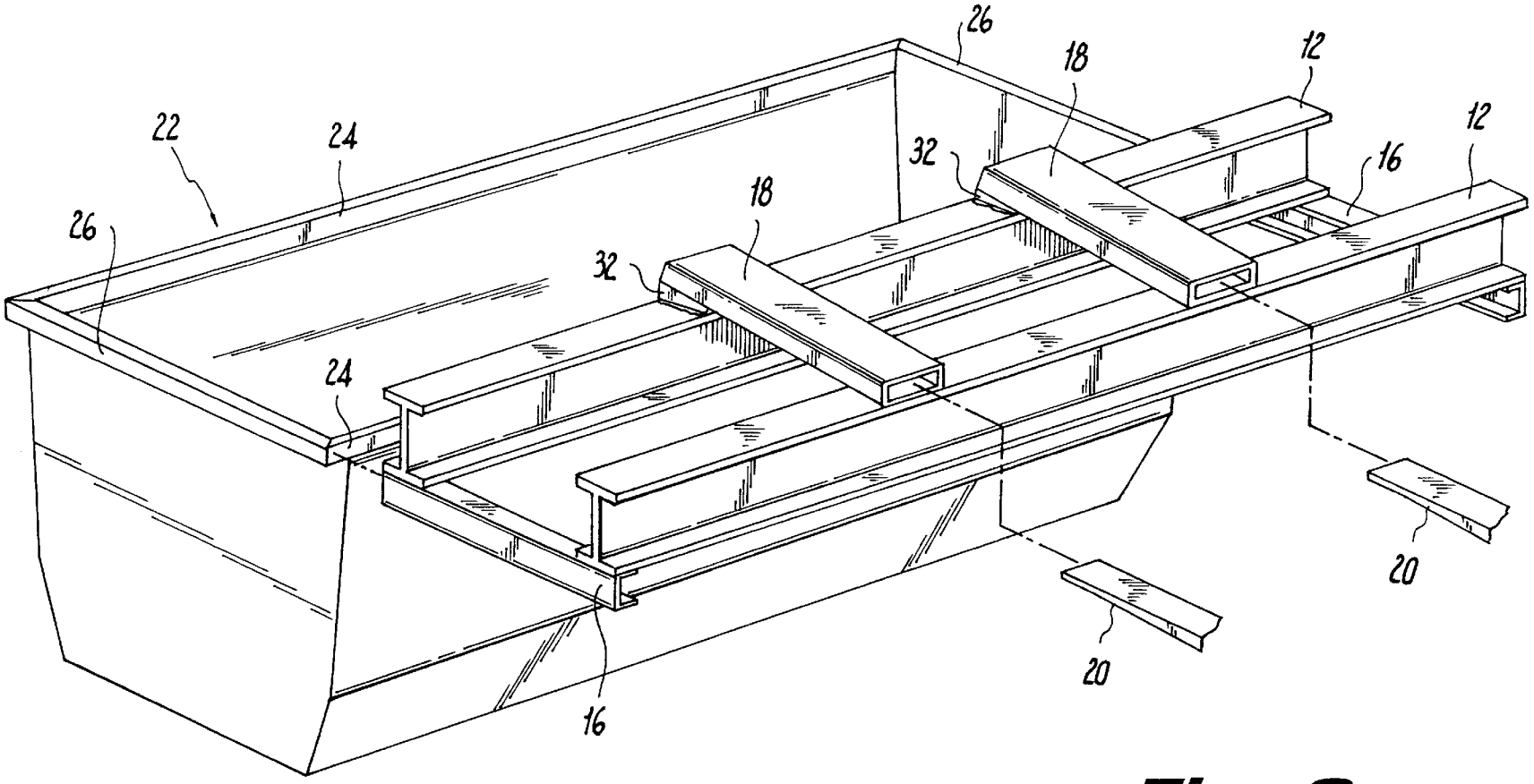
FIG. 3 is a perspective view illustration of a second embodiment of the container handling apparatus of the instant invention.

The embodiment shown in FIG. 3, and illustrated in a side view as carried by a forklift and engaged with a container being lifted in FIG. 4, differs in several respects from the simplest embodiment shown in FIG. 1. The second embodiment is configured to engage container 22 by captivating the transverse support rails 26 at the top of the end walls of the container, which are approximately twenty feet apart, where the embodiment of FIG. 1 captivates the longitudinal support rails 24, which are approximately eight feet apart. These distances in turn govern the lengths of structural elements 12 of the instant invention 10, making the second embodiment considerably larger, heavier and more costly than the first. The first embodiment is therefore used with the forklift positioned at the end of the container, longitudinally oriented with the container. This has the additional benefit of enabling the apparatus to be used to move containers into or out of box type bodies as described above. On the other hand, the first embodiment also places the center of gravity of the carried load substantially further ahead of the forklift which may increase the hazard of tipping the forklift over in the forward direction, and may necessitate the addition of ballast to the rear end of the forklift for stability if the container is heavily loaded.

The embodiment of FIGS. 3 and 4 while sharing the use of rectangular tubing sections 18 as means for engaging the blades of a forklift, illustrates how the rectangular tubing sections may be mounted to the top of transverse structural elements, in turn enabling channeled engagement rails 16 to be mounted directly to the undersides of transverse structural elements 12, eliminating the need for vertical rail support members 14. Additionally, the embodiment shown in FIGS. 3 and 4 illustrates the use of spacing blocks 32 which position the forward ends of forklift blades 20 slightly higher than the back ends of the blades. This has been found to stabilize the apparatus on the forklift when backing up to disengage the apparatus from a container. These differences, while generally contemplated as beneficial to the utility of the instant invention, are not included in the first embodiment since they negatively affect the size, weight and cost of the apparatus.

Figure 6:
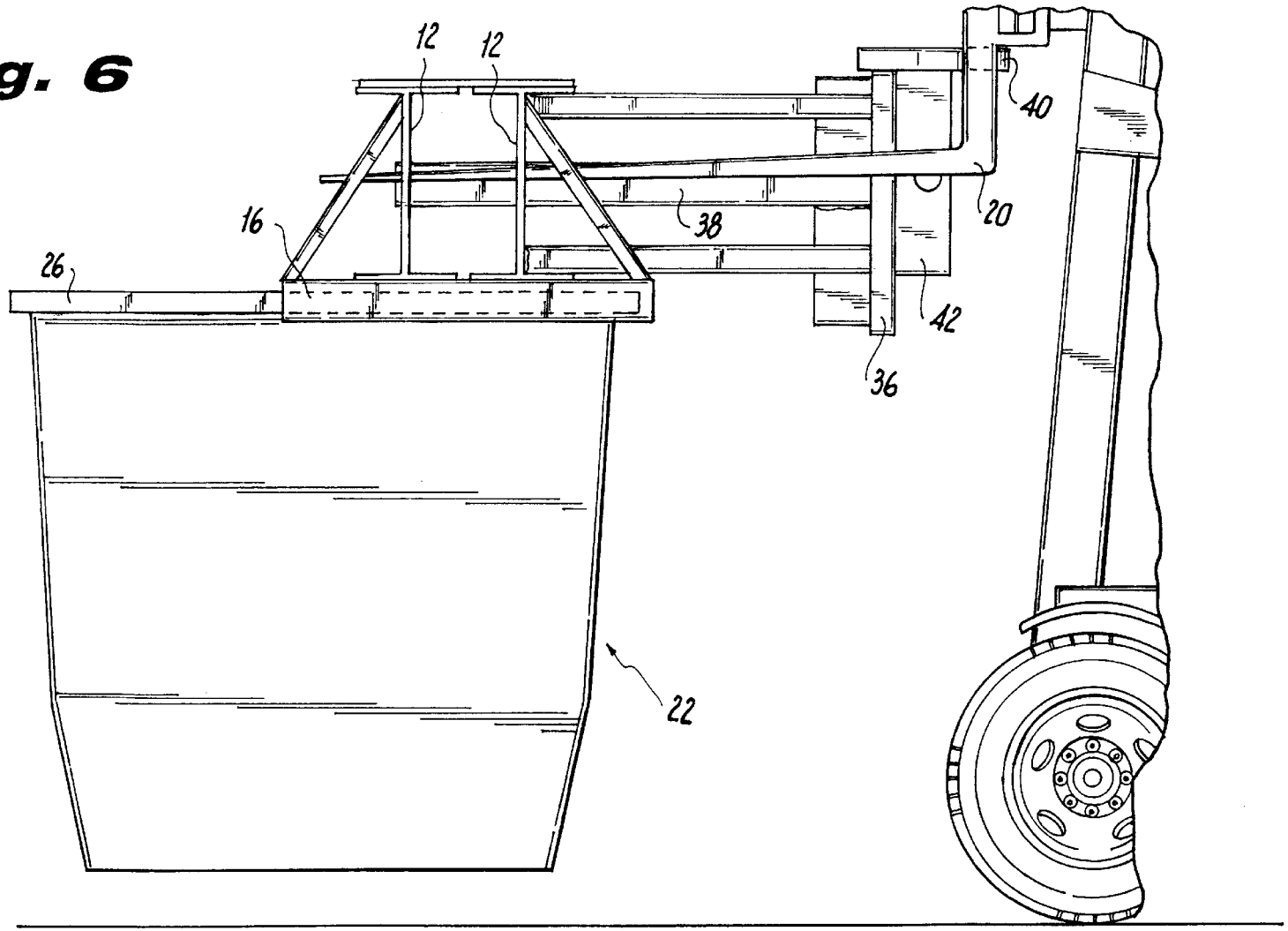
FIG. 6 is a side view of the embodiment of the present invention shown in FIG. 5, as being used by a large forklift.

FIGS. 5 and 6 illustrate a variation of the embodiment shown in FIGS. 3 and 4, having alternative means for engagement of the apparatus by a moving machine. Instead of rectangular tubing sections 18, fork receiving apertures 34 are shown through transverse structural elements 12 as an alternative means for receiving the blades 20 of a forklift for engaging the frame of the instant invention. Rear frame 36 integrates two additional means for engagement of the apparatus of the instant invention by accommodating structure common to other moving machinery typically larger than common forklifts, such as the machinery often found operating at large landfills. The first of these is rectangular beam receiver 38, for engagement of the apparatus by machines having a forwardly extending rectangular beam which can be articulated and moved as necessary to engage and use a variety of tools and equipment. A second method commonly used to couple tools and equipment to very large machinery, often called a "quick connect", employs a rearward pointing "V" shaped strap 40 in conjunction with a pair of vertical plates 42 having aligned bores through them for insertion of a pin therethrough for locating and locking the apparatus to a large machine. The machine end of this "quick connect" coupling has an upward pointing hook element which is hooked into the "V" shaped strap 40 of the apparatus from underneath, and a complimentary horizontal bore which aligns with the bores of vertical plates 42 for insertion of a pin for locating and locking the components together for conjoint motion.

Figure 7:
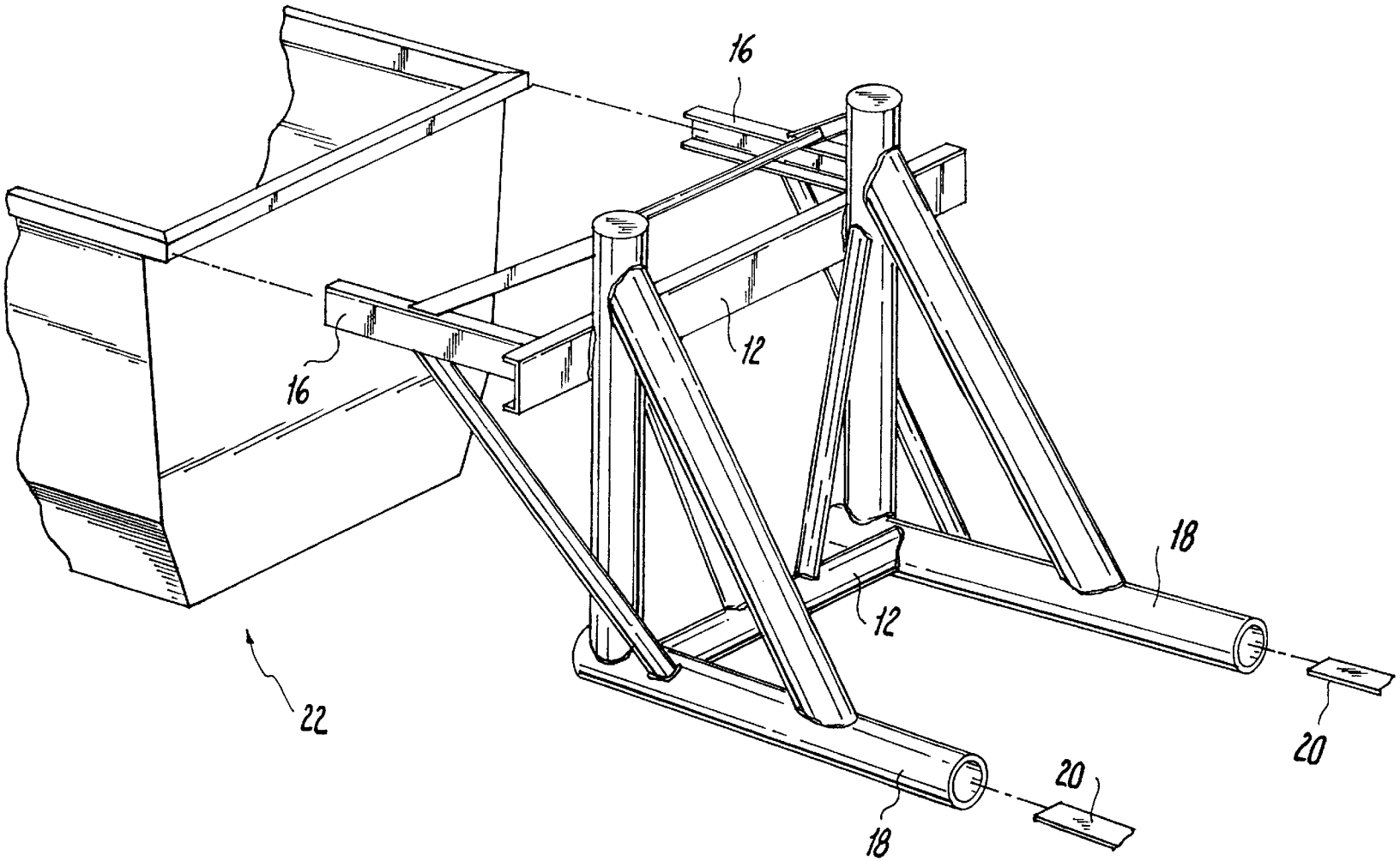
FIG. 7 is a perspective view of another embodiment of the apparatus having a positive vertical offset.
Figure 8:
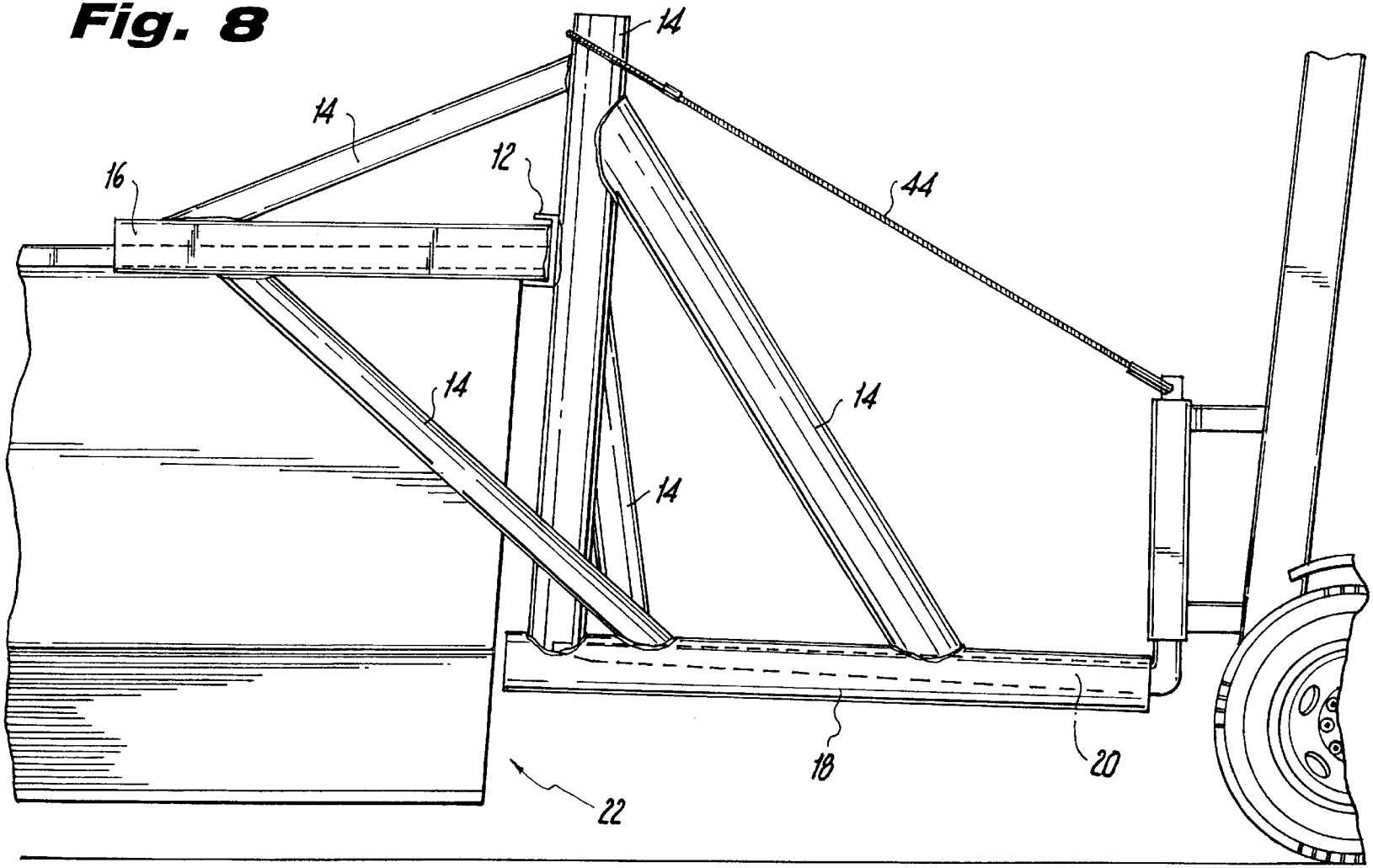
FIG. 8 is a side view of the apparatus of FIG. 7, depicting usage by a forklift to engage a container.

Turning now to FIGS. 7 and 8, yet another embodiment of the present invention is shown which somewhat oppositely employs vertical support members 14 so that engagement rails 16 are displaced to a position above forklift blade receivers 18. This provides a positive vertical offset to the lifting range of the forklift, which enhances the utility of such a moving machine when containers must be lifted for stack operations as described above. Another case where this positive vertical offset is advantageous is when loading or unloading a container in a box type body which is elevated by the chassis of a truck or railway car, without need for a loading dock.

Structural variations of note in the embodiment of FIGS. 7 and 8 include the use of round tubing to receive forklift blades as a means for engaging a moving machine. It should be further noted that vertical support members 14 are not necessarily in a purely vertical orientation, although they have some vertical component for supporting container engagement rails 16 at a location vertically displaced from where the apparatus is engaged by the moving machine. The vertical support members 14 and transverse structural elements 12 may also be mounted more rearwardly with respect to machine engagement means 18 in order to reduce the overhung nature of the container load.

Retention cable 44 is shown in FIG. 8 to prevent disengagement of the apparatus from the moving machine when disengaging a container from the apparatus, and is an alternative to inclination of blade receiving means as demonstrated in FIGS. 3 and 4 and described above. Numerous other means may be used for retaining the apparatus on the moving machine will be obvious to those of skill in the art, including the use of other tensile elements such as rope or chain to tie the apparatus to the moving machine, or by providing the interfacing components of the apparatus and the moving machine with alignable bores which can be pinned or bolted together.

Figure 9:
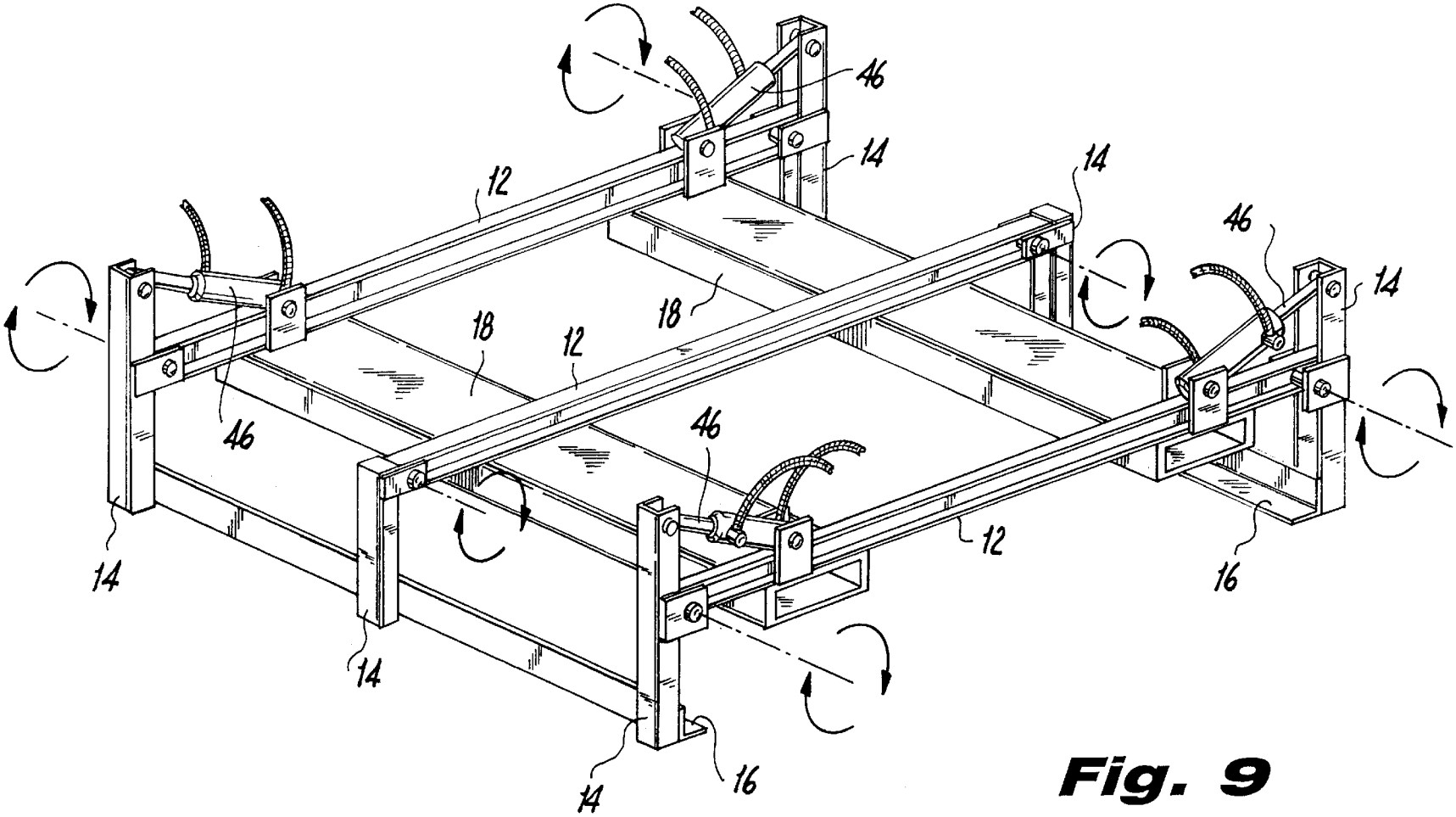
FIG. 9 is a depiction of the embodiment of FIG. 1, equipped with positionable gripping engagement rails.

As mentioned above, rough service and abusive handling can often cause bulk material containers to become dented, bent and otherwise distorted with age. These containers may likely be difficult to engage within the straight channeled engagement rails 16 of the above described embodiments of the present invention, even if the channels are significantly wider than the lips or rim of the container, and even if the entry point to the channels are flared. Under such circumstances, features shown in the embodiment of FIG. 9 may be particularly useful. Therein it can be seen that container engagement rails 16 each have only one inwardly directed lip so that a sort of shelf is formed by the pair, and a larger channel formed between such shelf and the frame of the apparatus. Additionally, container engagement rails 16 are moveable under impetus of hydraulic cylinders 46, which are easily coupled to the hydraulic systems common on most heavy machinery. Thus the apparatus can be clamped upon the distorted top rim of a container with the lips of rails 16 engaging underneath the rim, as opposed to a sliding engagement contemplated by earlier embodiments. A pivoting arrangement is shown and is deemed preferable for ease of construction, however, if an even greater degree of distortion must be accommodated, container engagement rails 16 may be slideably mounted to the frame. Similarly, other types of linear actuators or telescoping power rams may be employed by the apparatus where circumstances make them preferable to hydraulic cylinders 46.

The best mode of practicing the instant invention will vary according to the circumstances under which the apparatus will be used. The various configurations and features of the instant Invention disclosed herein are intended to be combined as necessary to suit the tasks to be performed. Consequently, while the above specification contains many specificities, these should not be construed as limitations on the scope of the instant invention, but rather as an exemplification of the preferred embodiments thereof. Accordingly, the scope of the instant invention should not be determined by the embodiments shown, but rather by the claims appended hereto and their legal equivalents.

What is claimed is:

1. An apparatus for engagement of a container having at least a pair of substantially opposite externally protruding lips by a moving machine comprising:

a frame having means for engagement by a moving machine, and a pair of substantially parallel, horizontally oriented forwardly extending container engagement rails, said container engagement rails having inwardly directed opposing lips which form one or more channels substantially parallel to the longitudinal axis of the moving machine, said lips or channels being spaced from each other a distance slightly larger than the body of the container and slightly smaller than the distance between the outer edges of the externally protruding container lips, so that a shelf or slot is formed within and between which said externally protruding container lips can be captivated so that the container can be supported for lifting, lowering, or carrying by said container engagement rails when positioned around said externally protruding container lips.

2. The apparatus as set forth in claim 1, wherein said means for engagement by a moving machine comprise means for receiving the blades of a forklift, and are selected from the group consisting of frame apertures, rectangular tubing and round tubing.

3. The apparatus as set forth in claim 2, wherein said means for receiving the blades of a forklift is inclined with respect to said container engagement rails, so that when the apparatus is engaged by a forklift, the distal ends of the forklift blades are higher than the rest of the blades.

4. The apparatus as set forth in claim 1, wherein said container engagement rails are U channels.

5. The apparatus as set forth in claim 1, said frame further comprising a plurality of vertical support members coupled between said container engagement rails and said means for engagement by a moving machine, so that said container engagement rails are vertically displaced from said means for engagement by a moving machine.

6. The apparatus as set forth in claim 5, wherein said container engagement rails are located vertically above said means for engagement by a moving machine.

7. The apparatus as set forth in claim 5, wherein said container engagement rails and said vertical support members are movably coupled to said frame so that the externally protruding container lips can be gripped by said container engagement rails.

* * * * *